US009127510B2

(12) United States Patent
Stringer et al.

(10) Patent No.: US 9,127,510 B2
(45) Date of Patent: Sep. 8, 2015

(54) DUAL DRIVE DIRECTIONAL DRILLING SYSTEM

(71) Applicant: Vermeer Manufacturing Company, Pella, IA (US)

(72) Inventors: Matthew David Stringer, Pella, IA (US); Nathaniel Zadok Gustavson, Pella, IA (US); Michael Dale Van Zee, Pella, IA (US); Philip Robert Lane, Pella, IA (US); Kevin Duane Sebolt, Udell, IA (US); Tod J. Michael, Chariton, IA (US)

(73) Assignee: Vermeer Manufacturing Company, Pella, IA (US)

( * ) Notice: Subject to any disclaimer, the term of this patent is extended or adjusted under 35 U.S.C. 154(b) by 329 days.

(21) Appl. No.: 13/651,086

(22) Filed: Oct. 12, 2012

(65) Prior Publication Data

US 2014/0102799 A1 Apr. 17, 2014

(51) Int. Cl.

| | |
|---|---|
| ***E21B 7/04*** | (2006.01) |
| ***E21B 3/02*** | (2006.01) |
| ***B60K 37/02*** | (2006.01) |

(52) U.S. Cl.

CPC . *E21B 7/046* (2013.01); *E21B 3/02* (2013.01); *E21B 7/04* (2013.01)

(58) Field of Classification Search

CPC ..... E21B 7/46; E21B 44/00; E21B 16/165; E21B 19/165; E21B 7/046; E21B 3/02; E21B 44/02

USPC ..... 175/61, 219, 162, 202, 203, 220, 27, 62

See application file for complete search history.

(56) References Cited

U.S. PATENT DOCUMENTS

| | | | | |
|---|---|---|---|---|
| 3,072,203 | A * | 1/1963 | Bendixen | 173/145 |
| 3,107,738 | A * | 10/1963 | Osborn | 173/74 |
| 3,586,116 | A | 6/1971 | Tirapolsky et al. | |
| 4,474,252 | A * | 10/1984 | Thompson | 175/69 |
| 4,667,751 | A | 5/1987 | Geczy et al. | |
| 4,947,944 | A | 8/1990 | Coltman et al. | |
| 5,086,869 | A * | 2/1992 | Newbery et al. | 180/329 |
| 5,490,569 | A | 2/1996 | Brotherton et al. | |
| 5,682,956 | A | 11/1997 | Deken et al. | |
| 6,029,951 | A * | 2/2000 | Guggari | 254/269 |
| 6,408,952 | B1 | 6/2002 | Brand et al. | |
| 6,629,572 | B2 * | 10/2003 | Womer et al. | 175/219 |
| RE38,418 | E * | 2/2004 | Deken et al. | 175/19 |

(Continued)

FOREIGN PATENT DOCUMENTS

| | | |
|---|---|---|
| DE | 3928619 | 3/1991 |
| JP | 01-260192 | 10/1989 |
| JP | 03-090790 | 4/1991 |

*Primary Examiner* — Jennifer H Gay

(74) *Attorney, Agent, or Firm* — Merchant & Gould P.C.

(57) ABSTRACT

A dual drive drilling system having a plurality of drill rods that make up a drill string and a steering element for controlling the path of the drill string is disclosed. The dual drive drilling system also includes a drill bit located near the end of the drill string, a first rotational drive for controlling the rotation of a steering element, and a second rotational drive for controlling the rotation of a drill bit. Further, the dual drive drilling system also includes a joystick capable of moving along a first and second axis for controlling both the first and second rotational drives, wherein the movement of the joystick along the first axis controls rotation of the first rotational drive, and the movement of the joystick along the second axis controls rotation of the second rotational drive.

19 Claims, 9 Drawing Sheets

(56) References Cited

U.S. PATENT DOCUMENTS

| | | | | |
|---|---|---|---|---|
| 7,389,831 | B2 * | 6/2008 | Mullins et al. | 175/62 |
| 7,413,031 | B2 | 8/2008 | Koch et al. | |
| 7,497,274 | B1 * | 3/2009 | Randall et al. | 173/152 |
| 7,562,724 | B2 * | 7/2009 | Allred et al. | 175/85 |
| 7,753,140 | B2 * | 7/2010 | Barbera | 175/62 |
| 7,770,659 | B2 * | 8/2010 | Uelhoff et al. | 173/1 |
| 7,987,924 | B2 * | 8/2011 | Mitchell et al. | 175/27 |
| 8,033,345 | B1 * | 10/2011 | Randall et al. | 175/27 |
| 8,286,726 | B2 * | 10/2012 | Muona et al. | 175/24 |
| 2002/0046882 | A1 * | 4/2002 | Smith, Jr. | 175/19 |
| 2002/0060093 | A1 * | 5/2002 | Womer et al. | 175/24 |
| 2002/0157870 | A1 * | 10/2002 | Bischel et al. | 175/52 |
| 2004/0028476 | A1 * | 2/2004 | Payne et al. | 405/184 |
| 2005/0274548 | A1 * | 12/2005 | Albert et al. | 175/61 |
| 2007/0119623 | A1 * | 5/2007 | Sewell et al. | 175/52 |
| 2008/0073123 | A1 * | 3/2008 | Mullins et al. | 175/62 |
| 2009/0153370 | A1 * | 6/2009 | Cooper et al. | 341/21 |
| 2010/0133009 | A1 * | 6/2010 | Carlson et al. | 175/45 |
| 2010/0139982 | A1 * | 6/2010 | Carlson et al. | 175/62 |
| 2010/0215449 | A1 * | 8/2010 | Kern | 408/1 R |
| 2010/0243326 | A1 * | 9/2010 | Jin et al. | 175/45 |
| 2010/0307824 | A1 * | 12/2010 | Mitchell et al. | 175/27 |
| 2011/0005838 | A1 * | 1/2011 | Granberg et al. | 175/61 |
| 2012/0255779 | A1 * | 10/2012 | Mitchell et al. | 175/27 |
| 2013/0008718 | A1 * | 1/2013 | Nguyen et al. | 175/48 |
| 2013/0068490 | A1 * | 3/2013 | Van Zee et al. | 173/1 |
| 2013/0118810 | A1 * | 5/2013 | Mercer | 175/45 |
| 2013/0140092 | A1 * | 6/2013 | Warr | 175/219 |
| 2013/0313022 | A1 * | 11/2013 | Kirkhope et al. | 175/104 |
| 2013/0341965 | A1 * | 12/2013 | Flusche | 296/190.04 |
| 2013/0343858 | A1 * | 12/2013 | Flusche | 414/800 |
| 2014/0102799 | A1 * | 4/2014 | Stringer et al. | 175/61 |
| 2014/0284111 | A1 * | 9/2014 | Van Zee et al. | 175/122 |

* cited by examiner

DUAL DRIVE DIRECTIONAL DRILLING SYSTEM

TECHNICAL FIELD

The present disclosure provides a control system and method for operating a dual drive directional drilling system.

BACKGROUND

Dual drive drilling systems for use in directional drilling are known. A typical dual drive drilling system is generally configured to drive into the ground a series of drill rods joined end-to-end to form a drill string. At the end of the drill string is a rotating drilling tool, or drill bit. A dual drive drilling system typically includes a first drive mechanism that controls rotation of a drill bit and a second drive mechanism that controls rotation of a steering element. When a straight hole is drilled with a dual drive drilling system, the first and second drive mechanisms are concurrently operated such that both the drill bit and the steering element are rotated as the drill string is thrust into the ground. When a directional change is needed the drive mechanism that controls the steering element is stopped. After the steering element has been stopped, the drill string is thrust further into the ground while the drive mechanism that controls the drill bit is rotated. This causes the drill bit to deviate from a straight path and follow the direction dictated by the steering element. One example of a dual drive drilling system includes a mud motor system. A mud motor system includes an above ground drive mechanism that controls a steering element and a drill bit drive mechanism, such as a mud motor, that is carried down-hole by the drill string during drilling. Examples of mud motor systems include U.S. Pat. No. 3,586,116, U.S. Pat. No. 4,667,751, and U.S. Pat. No. 4,947,944. Another type of a dual drive drilling system uses a two pipe system in which both the drive mechanisms for the steering element and the drill bit are located on a drilling machine that is typically anchored above ground during drilling. Examples of two pipe systems include DE 3928619, JP 03-090790, JP 01-260192, and U.S. Pat. No. 5,490,569. Due to the complicated nature of driving both the steering element and the drill bit concurrently and at different times, improvements to the control system of a dual drive drilling system are needed.

SUMMARY

One aspect of the present disclosure relates to a dual drive drilling system having a plurality of drill rods that make up a drill string, and a steering element for controlling the path of the drill string. The dual drive drilling system also includes a drill bit located near the end of the drill string, a first rotational drive for controlling the rotation of a steering element, and a second rotational drive for controlling the rotation of a drill bit. Further the dual drive drilling system also includes a joystick capable of moving along a first and second axis for controlling both the first and second rotational drives, wherein the movement of the joystick along the first axis controls rotation of the first rotational drive, and the movement of the joystick along the second axis controls rotation of the second rotational drive. In certain embodiments, the dual drive drilling system can further include a speed control knob for limiting a maximum rotational speed of the second rotational drive. In certain embodiments, the joystick can be self-centering, defining a neutral position along both the first and second axes. In certain embodiments, the dual drive drilling system can include three modes of operation. When in the first mode the system will control the rotation of the second rotational drive in two directions. When in the second mode the system will control the rotation of the second rotational drive in one direction. When in the third mode the control system will control the rotation of the first rotational drive and will not control the rotation of the second rotational drive.

Another aspect of the present disclosure relates to a method of controlling a dual drive drilling system. The dual drive system includes a plurality of drill rods that make up a drill string, a steering element for controlling the path of the drill string, a drill bit located near the end of the drill string, a first rotational drive for controlling the rotation of a steering element, a second rotational drive for controlling the rotation of a drill bit and a first joystick. The method includes moving the first joystick along a first axis to control rotation of the first rotational drive and moving the first joystick along a second axis to control rotation of the second rotational drive.

Another aspect of the present disclosure relates to a dual drive drilling system having a joystick that is capable of moving to a location along a first axis and a second axis for controlling the rotation of a first rotational drive and a second rotational drive, the first rotational drive controls the rotation of a steering element and the second rotational drive controls the rotation of a drill bit. The system also includes a throttle capable of controlling the amount of thrust applied to the steering element and to the drill bit. The system further includes a speed control knob for limiting a maximum rotational speed of the second rotational drive and a steering element speed switch that controls maximum speed of the steering element. The system further includes a switch capable of initiating an auto-drill operation at the rotational speeds set by the location of the joystick. Also, a stop function that stops rotation of the second rotational drive is initiated when the first rotational drive stops rotation.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

The present disclosure relates to a control system for a dual drive drilling system having a first drive for rotating a steering element and a second drive for rotating a drill bit. In one embodiment the control system includes a multi-axis joystick for controlling operation of both the first and second drives. The present invention will now be described more fully hereinafter with reference to the accompanying drawings, in which preferred embodiments of the invention are shown. This invention may, however, be embodied in many different forms and should not be construed as limited to the embodiments set forth herein; rather these embodiments are provided so that this disclosure will be thorough and complete, and will fully convey the scope of the invention to those skilled in the art.

The dual drive drilling system includes a drilling machine that is located above ground. Attached to the dual drive drilling machine is a drill string that consists of individual drill segments and a drill head. The drill head includes a rotatable drill bit and a rotatable steering element. The dual drive drilling system has a first drive mechanism for controlling the rotation of the steering element and a second drive mechanism for controlling the rotation of the drill bit. In certain embodiments both the first and second drives may be located on the drilling machine which is located above ground. In other embodiments, the second drive may be a mud-motor or like device incorporated into the drill string adjacent the drill head. Additionally, in certain embodiments the drill segments can include both inner and outer members that are rotatable relative to one another.

Figure 1:
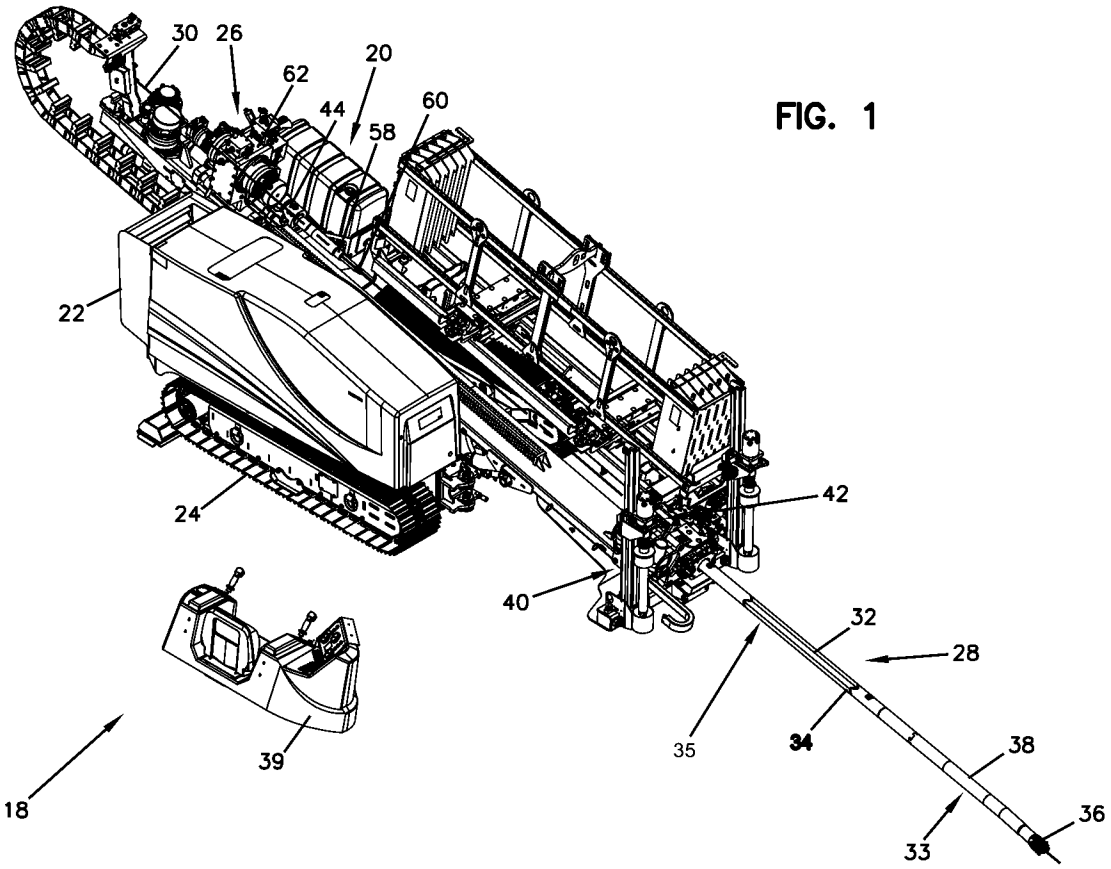
FIG. 1 is a perspective view showing a dual drive drilling system.

Referring to FIG. 1, a dual drive drilling system 18 according to an embodiment of the present disclosure is schematically shown. The dual drive drilling system 18 includes a directional drilling machine 20 for directing a drill string 28 into the ground. In some embodiments, the drilling machine 20 includes an operator control station 39 attached to or in communication with the drilling machine 20. The operator control station 39 is shown detached from the drilling machine 20 in FIG. 1 as it is appreciated that the control station may be attached to a variety of different locations on the drilling machine 20. In some embodiments, the drilling machine 20 includes a chassis 22 supported on wheels or tracks 24. The chassis 22 supports a drill string drive assembly 26. The drill string drive assembly 26 is configured to rotate the drill string 28 about a drill axis 30, and push and pull the drill string 28 about the drill axis 30. In the depicted embodiment, the drill string 28 includes drill segments 31 that are strung together end-to-end to form the drill string 28. The drill string 28 also includes a drill head arrangement 33 that mounts at the distal end of the string of drill segments 31. The drill head arrangement 33 can include structures such as a starter rod 35, a steering element 38 (e.g. bent sub, bent housing, or like bent steering structure) and a drill bit 36. The drill segments 31 each include inner and outer members 32, 34 that can be rotated independent of each other by way of the drill string drive assembly 26. The inner members 32 of the drill string 28 are collectively used to drive the rotation of the drill bit 36, while the outer members of the drill string 28 are collectively used to rotate and/or control the rotational orientation of the steering element 38. The drill string drive assembly 26 includes a first rotational drive 58 for rotating the outer members 34 and thus the steering element 38 about the drill axis 30. The drill string drive assembly 28 also includes a second rotational drive 60 for rotating the inner members 32 and thus the drill bit 36 about the drill axis 30. The drill string drive assembly 26 further includes a longitudinal drive 62 for thrusting/pushing the drill string 28 into the ground during drilling and for pulling the drill string 28 from the ground during back reaming or drill string retrieval.

Steering can be accomplished by the use of a steering element 38. To drill straight, the longitudinal drive 62 thrusts the drill string 28 into the ground while the first and second rotational drives are simultaneously activated causing the drill bit 36 to be rotated by the inner members 32 and the steering element 38 to be rotated by the outer members 34. When a directional change is desired, the first rotational drive 58 is deactivated thereby stopping rotation of the steering element 38. After the steering element 38 has stopped rotating, the drill string 28 is thrust further into the ground and the drill bit 36 is rotated by the second rotational drive 60. This causes the drill bit 36 to deviate from a straight path and follow the direction dictated by the bend of the steering element 38.

The drill string drive assembly 26 also includes a break out mechanism 40, which, in the preferred embodiment, contains a three vise system 42. A drill string rotational drive unit 44 carrying the first and second rotational drives 58, 60 is configured to be driven towards the break out mechanism 40 by the longitudinal drive 62 to push a section of the drill string 28 into the ground, and be pulled away from the break out mechanism 40 by the longitudinal drive 62 to pull a section of the drill string 28 from the ground. During the pushing and the pulling, the drive unit 44 can also rotate the inner and outer members 32, 34 of the drill string 28 about the drill axis 30.

Figure 2:
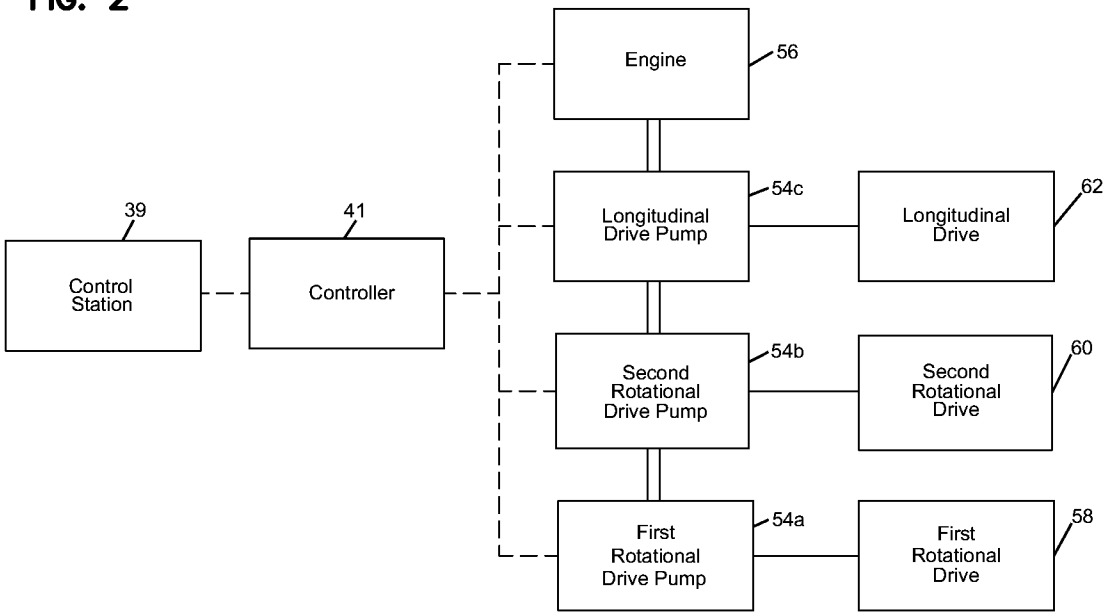
FIG. 2 is a schematic depiction of the operating characteristics of a dual drive drilling system.

Referring to FIG. 2, the drilling machine 20 includes an operator control station 39 for controlling operation of the drilling machine 20. The control station 39 serves to provide inputs to a controller 41. Although drawn as a single controller 41, it is appreciated that a plurality of controllers may be utilized. The controller 41 then outputs signals to a series of pumps; a first rotational drive pump 54*a*, a second rotational drive pump 54*b*, and a longitudinal drive pump 54*c*. The series of pumps are powered by an engine 56. The pumps 54*a*, 54*b*, 54*c* provide hydraulic power to the drill string rotational drive unit 44, specifically a first rotational drive 58, a second rotational drive 60, and a longitudinal drive 62.

Figure 3:
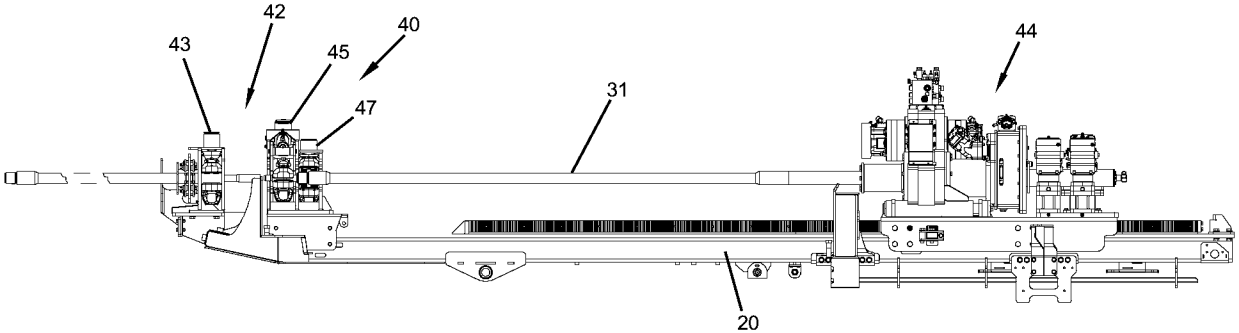
FIG. 3 is a side view of a drill string drive assembly of a dual drive drilling system similar to the system in FIG. 1 with a drive assembly of the present invention on one end, and a break out mechanism of the present invention, with a vise system on the other end.

FIG. 3 is a side view of the drill string drive assembly of the drilling machine 20 in FIG. 1 showing the rotational drive unit 44 on one end, and a break out mechanism 40 on the other end. The break out mechanism 40 includes a vise system 42. The vise system 42 includes three vises, or clamping mechanisms: a low vise 43, a middle vise 45, and an upper vise 47. The three vises work in harmony to couple and uncouple drill segments 31. As an example, a method of vise operation is disclosed in PCT Publication No. WO2011/146490 and is hereby incorporated by reference in its entirety. While a three vise system is disclosed for adding and removing drill rod, it will be appreciated that this invention may be used with any type of control system for a dual drive drilling machine, regardless of the number of vises. In the one embodiment the dual drive drilling system 18 may have multiple operating modes. One mode is a drilling mode in which no vises are activated (i.e. clamped). In certain embodiments other alternative modes can correspond to different steps in the drilling process (e.g. removing/breaking out drill segments, or adding drill segments). These modes may allow the dual drive drilling system to control the drilling process differently. These alternative modes may be activated manually or by sensing characteristics and/or operating characteristics of the drilling machine 20 (e.g. which, if any, vises are activated).

Figure 4:
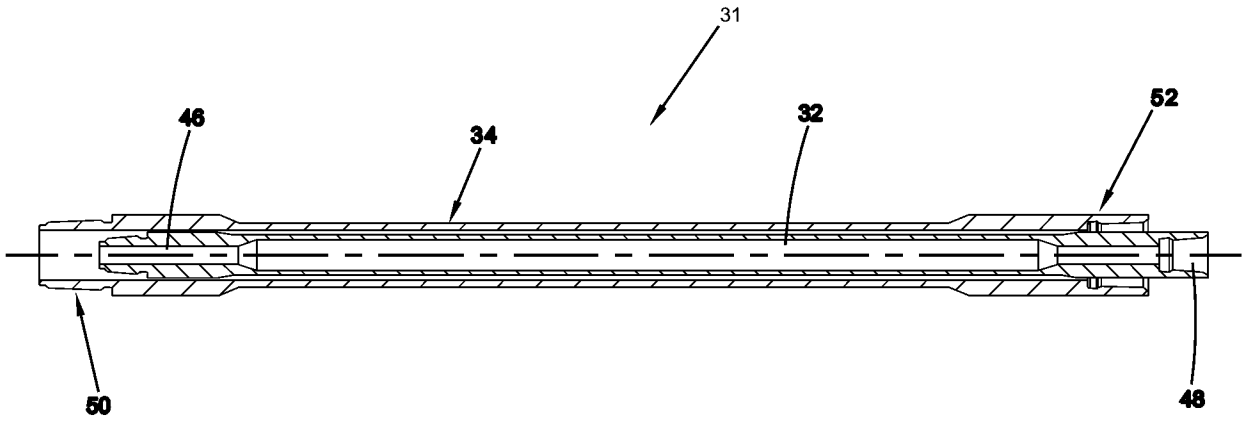
FIG. 4 is a cross-sectional view of a drill segment.

FIG. 4 is cross-sectional view of a drill segment 31 in the preferred embodiment. The inner members (rods) 32 are connected to each other and to the drive unit 44 via a threaded connection. Each inner member includes one male end 46 and one female end 48, wherein the male and female ends are configured to be secured to the opposed end of an identically configured inner member 32. The threaded connection between the inner members allows rotational force (torque) applied to one inner member 32 to be transferred to another inner member 32. The threaded connection between the inner members also allows axial thrust and tension forces (pushing and pulling forces applied by the drive unit 44) to be transferred from one inner member to another inner member. In a complete coupled drill string 28 the inner rods 32 are not visible from the operator station 39 as the coupled outer rods 34 shield the inner rods 32 from view.

Referring still to FIG. 4 the first end 50 of the outer member 34 is configured to interlock with the second end 52 of an identical outer member 34, and the second end 52 of the outer member 34 is configured to interlock with the first end 50 of an identical outer member 34. In one embodiment the outer rods 34 may interlock via a threaded connection. In certain embodiments the outer rods 34 may interlock via a non-threaded connection.

Figure 5:
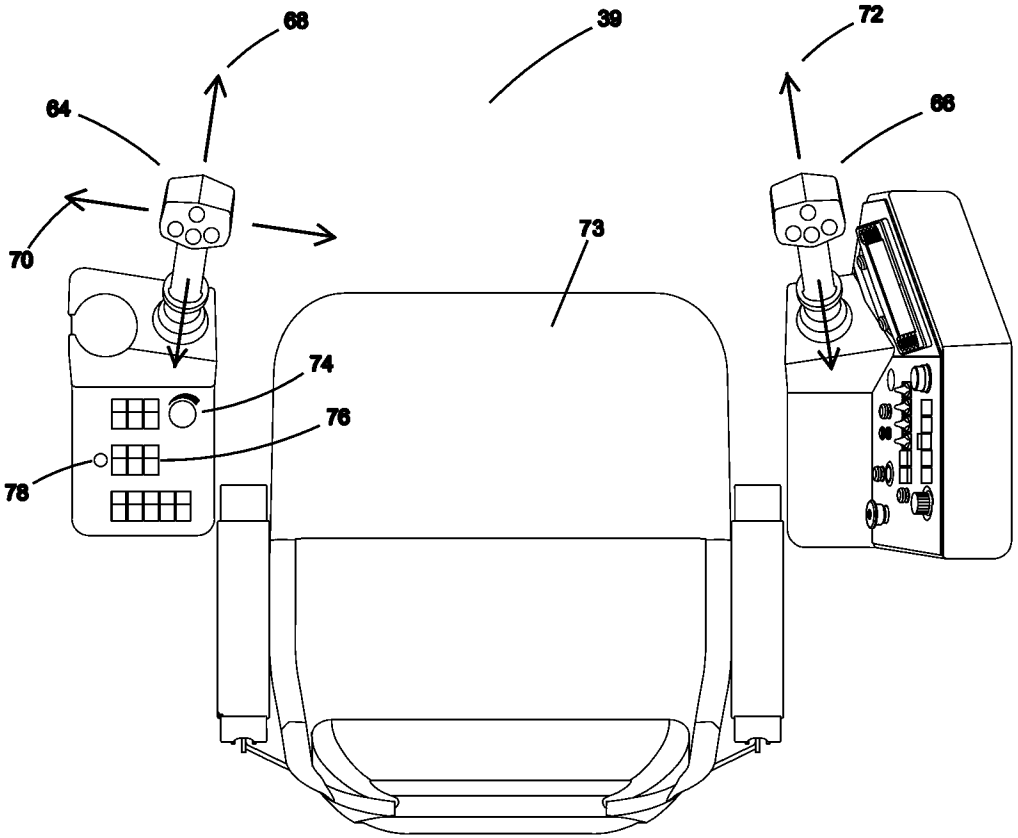
FIG. 5 is a top view of the operator station of FIG. 1.

FIG. 5 shows an operator control station 39. The operator control station 39 includes both left and right hand controls. In the depicted embodiment, the control station 39 includes a left hand joystick 64 and a right-hand joystick 66. The left hand joystick 64 controls the rotation of both the outer 34 and inner rods 32 via the first rotational drive 58 and second rotational drive 60. The right-hand joystick 66 controls the axial thrust and tension forces applied to the drill string 28 via the longitudinal drive 62. The left hand joystick 64 is capable of moving along a first axis 68 and second axis 70. The right hand joystick 66 is capable of moving along one axis 72. Both left and right hand joysticks 64, 66 are self-centering. Further the operator station 39 includes a seat 73. Additionally, the operator control station 39 includes a speed control knob 74. The speed control knob 74 limits the maximum rotational speed of the second rotational drive 60 and thus the inner rods 32. The operator control station 39 also includes an outer rod speed switch 76 that controls the maximum speed of the outer drill rods 34 by controlling the maximum speed of the first rotational drive 58. Furthermore, the operator control station 39 includes an automatic drilling switch 78. The switch 78 enables automatic operation of the dual rod directional drill at the operating parameters selected at the time when the automatic drilling switch is activated. For example, once the desired rotational speeds of the first and second rotational drives 58, 60 have been established through manipulation of the left hand joystick 64 and the desired thrust/pull-back has been established through manipulation of the right joystick 66, the automatic drilling switch 78 can be activation to lock the established rotational speeds and the established thrust/pull-back. In other embodiments the automatic drilling switch can lock the speed of the first rotational drive through manipulation of the left hand joystick 64 while the second rotational drive will be locked at the speed that the speed control knob 74 is set at. Once the established parameters have been locked, the joysticks 64, 66 can be released and the established operational parameters are automatically maintained. The automatic operation of the first and second rotational drives 58, 60 and the longitudinal drive 62 can be deactivated by activating any control item on the control panel. Once the automatic operation has been deactivated, the first and second rotational drives 58, 60 and the longitudinal drive 62 stop.

Figure 6:
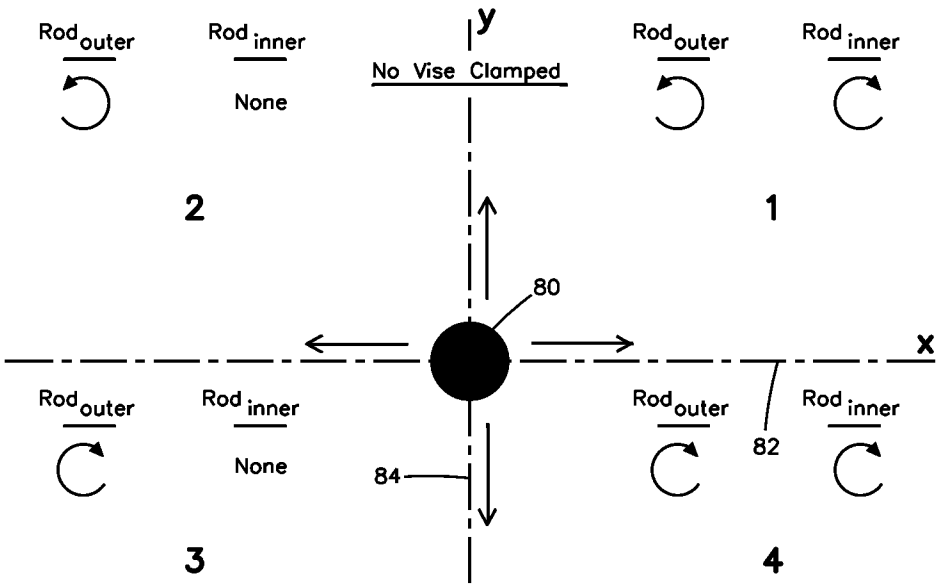
FIG. 6 is a top view of a quadrant rotational diagram of the left-hand joystick of FIG. 5 when no vise of the break out mechanism is clamped.

FIG. 6, shows a top view of a quadrant rotational diagram of the left-hand joystick 64 when in drilling mode. In certain embodiments the operator may enter this mode when none of the vises 43, 45, 47 of the break out mechanism 40 have been activated. The left hand joystick 64 is shown in a neutral central position 80 located at the center, or origin, of the diagram. The x-axis 82 is defined as the horizontal axis while the y-axis 84 is defined as the vertical axis. Movement of the joysticks along the y-axis 84 controls the rotational speed of the first rotational drive 58 and movement of the joystick 64 along the x-axis 82 controls the rotational speed of the second rotational drive 60. As the joystick 64 travels away from the central neutral position along the two axes, rotational speeds increase. In one embodiment an interlock type of functionality can be implemented where second rotational drive 60 would be either on or off. In such an embodiment, if the joystick 64 is moved from the central neutral position 80 in a direction past a preset trigger point along the y-axis 84, the inner rod 32 would rotate at the speed set by the speed control knob 74, regardless of the joystick's 64 position, until the joystick was returned to the neutral position 80.

Still referring to FIG. 6, in another embodiment a proportional speed function may be utilized to control the speed of the inner rod 32 as the joystick 64 travels away from the central neutral position 80 along the x-axis 82. In such an embodiment, the inner rod rotational speed would be zero at the neutral position 80, and the inner rod rotational speed would be a maximum rotational speed at a maximum position along the x-axis 82. The maximum rotational speed is set by the position of the speed control knob 74, and the inner rod rotational speed is proportional anywhere between the neutral position 80 and a maximum position.

Still referring to FIG. 6, in yet another embodiment a clipped speed function may be utilized to control the speed of the inner rod 32 as the joystick travels away from the central neutral position 80. In this embodiment the inner rod rotational speed would be zero at the central neutral position 80 and at a maximum speed at any maximum right position. The inner rod rotational speed is proportional anywhere between the neutral position 80 and the maximum right position but only up to a speed not exceeding the speed selected by the position of the speed control knob 74.

Still referring to FIG. 6, when the drill is operating in the mode shown (i.e. no vises clamped) the inner rod 32 will be prevented from being rotated in a first rotational direction (e.g. in a counterclockwise direction) that corresponds to loosening of the threaded connections between the inner rods 32. This is to ensure that the operator does not unthread the inner rods 32 during the drilling process. The outer rods 34 will still be permitted to rotate in the first rotational direction to facilitate steering of the drill string 28. If the joystick 64 is moved from the origin 80 to quadrant 1, the upper right quadrant, the outer rod 34 will begin to rotate in the first rotational direction while the inner rod 32 will begin to rotate in a second rotational direction (e.g. a clockwise direction) that corresponds with thread tightening. If the joystick 64 is moved from the origin 80 to the quadrant 2, the upper left quadrant, the outer rod 34 will begin to rotate in the first rotational direction; however, the inner rod 32 will not rotate. If the joystick 64 is moved from the origin 80 to the quadrant 3, the lower left quadrant, the outer rod 34 will begin to rotate in the second rotational direction; however, the inner rod 32 will not rotate. If the joystick 64 is moved from the origin 80 to the quadrant 4, the lower right quadrant, the outer rod 34 will begin to rotate in the second rotational direction and the inner rod 32 will begin to rotate in the second rotational direction. The operator will spend the most amount of time operating within quadrant 4 as most of the drilling process includes rotating both the inner and outer rods in the first rotational direction. Quadrant 4 is designed to be the quadrant that is closest to the operator.

Still referring the FIG. 6 if the joystick 64 is moved horizontally from quadrant 1 to quadrant 2 the outer rod 34 will rotate at a uniform speed; however, the inner rod will either begin to slow as the y-axis is approached and/or will eventually stop when the joystick 64 is positioned on the y-axis 84. As the joystick is moved into quadrant 2 the inner rod will not begin rotate again to prevent the unthreading of the inner rod 32. If the joystick 64 is moved vertically from quadrant 2 to quadrant 3 the outer rod 34 will slow down as the x-axis 82 is approached. Once the joystick 64 is positioned over the x-axis 82 the outer rod 34 will stop rotation. If movement of the joystick 64 is continued into quadrant 3 the outer rod will begin rotating in the second direction and the inner rod 32 will continue to not rotate. If the joystick 64 is moved horizontally from quadrant 3 to quadrant 4 the outer rod 34 will rotate at a uniform speed. The inner rod 32 will then begin rotating in the second rotational direction when the joystick 64 enters quadrant 4. If the joystick 64 is moved vertically from quadrant 4 to quadrant 1 the outer rod 34 will slow down as the x-axis is approached while the inner rod 32 will continue to rotate at a consistent speed. Once the joystick 64 is positioned over the x-axis 82 the outer rod 34 will stop rotation and will initiate a stop function stopping the rotation of the inner rod 32. If movement of the joystick 64 is continued into quadrant 1 the outer rod 34 will begin rotating in a clockwise direction and the inner rod 32 will not restart rotating until the joystick is moved to the neutral position 80 and then re-positioned to quadrant 1, quadrant 2 or along the x-axis between quadrants 1 and 2.

Figure 7:
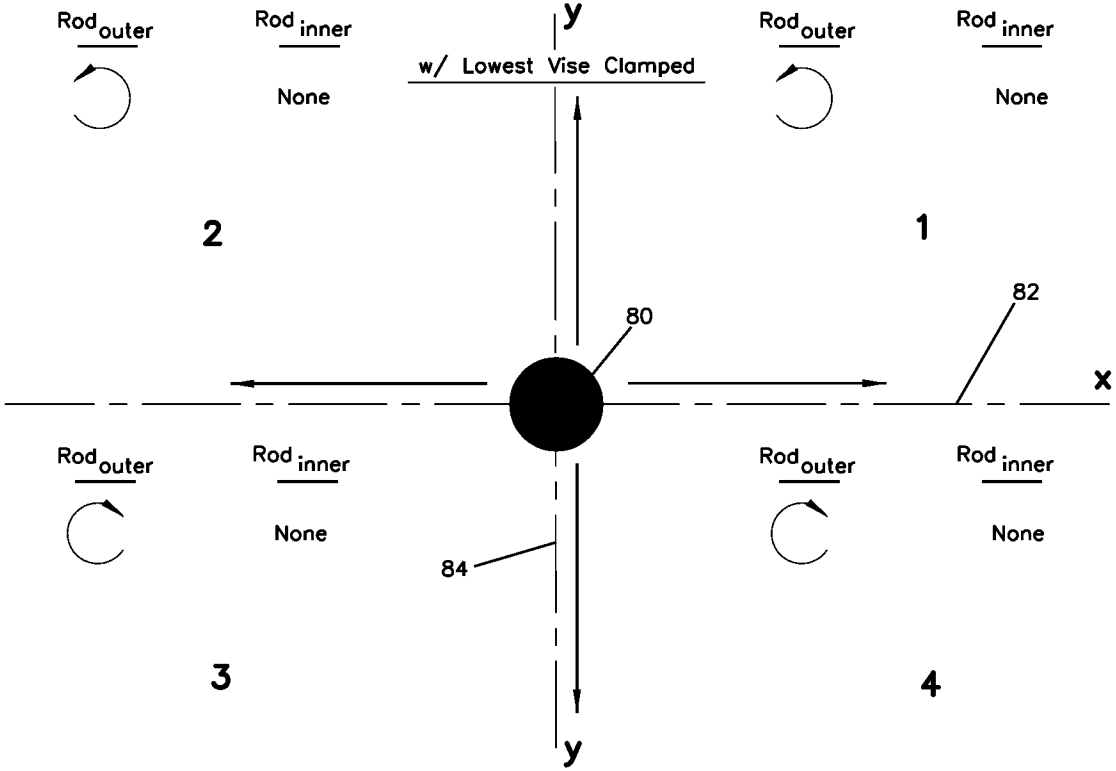
FIG. 7 is a top view of a quadrant rotational diagram of the left-hand joystick of FIG. 5 when the low vise of the break out mechanism is clamped.

FIG. 7 shows a top view of a quadrant rotational diagram of the left-hand joystick 64 when in an alternative breakout/make-up mode. In certain embodiments the mode may be activated when only the low vise in the vise system 42 of the break out mechanism 40 is clamped. The left hand joystick 64 is shown in a neutral central position 80 located at the center, or origin, of diagram. The x-axis 82 is defined as the horizontal axis while the y-axis 84 is defined as the vertical axis. When only the low vise is clamped in the vise system 42 there is no need for the inner rod to rotate. FIG. 7 shows that no inner rod rotation is enabled when the low vise is clamped.

Figure 8:
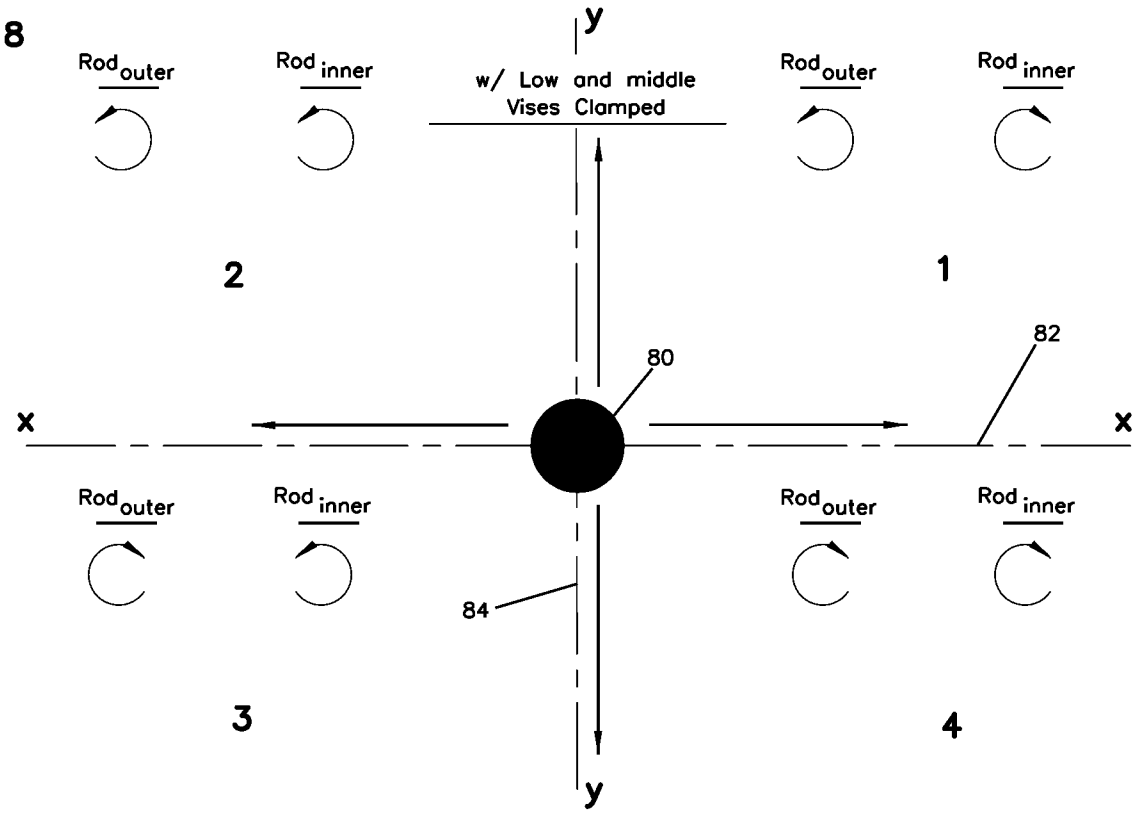
FIG. 8 is a top view of a quadrant rotational diagram of the left-hand joystick of FIG. 5 when both the low and middle vises of the break out mechanism are clamped.

FIG. 8 shows a top view of a quadrant rotational diagram of the left-hand joystick 64 when in an alternative breakout/make-up mode. In certain embodiments the mode may be activated when both the low and middle vise in the vise system 42 of the break out mechanism 40 are clamped. The following operating characteristics would take place when either adding a new piece of drill pipe or removing drill pipe. The left hand joystick 64 is shown in a neutral central position 80 located at the center, or origin, of diagram. The x-axis 82 is defined as the horizontal axis while the y-axis 84 is defined as the vertical axis. As the joystick 64 travels away from the central neutral position 80 along the two axes, rotational speeds increase. If the joystick 64 is moved from the origin 80 to quadrant 1, the upper right quadrant, the outer rod 34 will begin to rotate in the first rotational direction while the inner rod 32 will begin to rotate in the second rotational direction. If the joystick 64 is moved from the origin 80 to quadrant 2, the upper left quadrant, the outer rod 34 will begin to rotate in the first rotational direction and the inner rod 32 will begin to rotate in the first rotational direction. If the joystick 64 is moved from the origin 80 to quadrant 3, the lower left quadrant, the outer rod 34 will begin to rotate in the second rotational direction while the inner rod 32 will begin to rotate in the first rotational direction. If the joystick 64 is moved from the origin 80 to quadrant 4, the lower right quadrant, the outer rod 34 will begin to rotate in the second rotational direction and the inner rod 32 will begin to rotate in the second rotational direction.

Still referring to FIG. 8, if the joystick 64 is moved horizontally from quadrant 1 to quadrant 2 the outer rod 34 will rotate at a uniform speed; however, the inner rod 32 will begin to either slow as the y-axis 84 is approached and/or will eventually stop when the joystick 64 is positioned on the y-axis 84. The inner rod 32 will then begin rotating in the first rotational direction when the joystick 64 enters quadrant 2. If the joystick 64 is moved vertically from quadrant 2 to quadrant 3 the outer rod 34 will slow down as the x-axis 82 is approached while the inner rod 32 will continue to rotate at a consistent speed. Once the joystick 64 is positioned over the x-axis 82 the outer rod 34 will stop rotation and rotation of the inner rod 32 will also initiate a stop. If movement of the joystick 64 is continued into quadrant 3 the outer rod 34 will begin rotating in the second rotational direction and the inner rod 32 will not start rotating until the joystick 64 is moved the neutral position 80 and then re-positioned to quadrant 3. If the joystick 64 is moved horizontally from quadrant 3 to quadrant 4 the outer rod 32 will rotate at a uniform speed; however, the inner rod 32 will begin to slow as the y-axis 84 is approached and will eventually stop when the joystick 64 is positioned on the y-axis 84. The inner rod 32 will then begin rotating in the second rotational direction when the joystick 64 enters quadrant 4. If the joystick 64 is moved vertically from quadrant 4 to quadrant 1 the outer rod 34 will slow down as the x-axis is approached while the inner rod 32 will continue to rotate at a consistent speed. Once the joystick 64 is positioned over the x-axis 82 the outer rod 34 will initiate a stop function stopping the rotation of the inner rod. If movement of the joystick 64 is continued into quadrant 1 the outer rod 34 will begin rotating in a clockwise direction and the inner rod 32 will not restart rotating until the joystick 64 is moved to the neutral position 80 and then re-positioned to any of the four quadrants.

Figure 9:
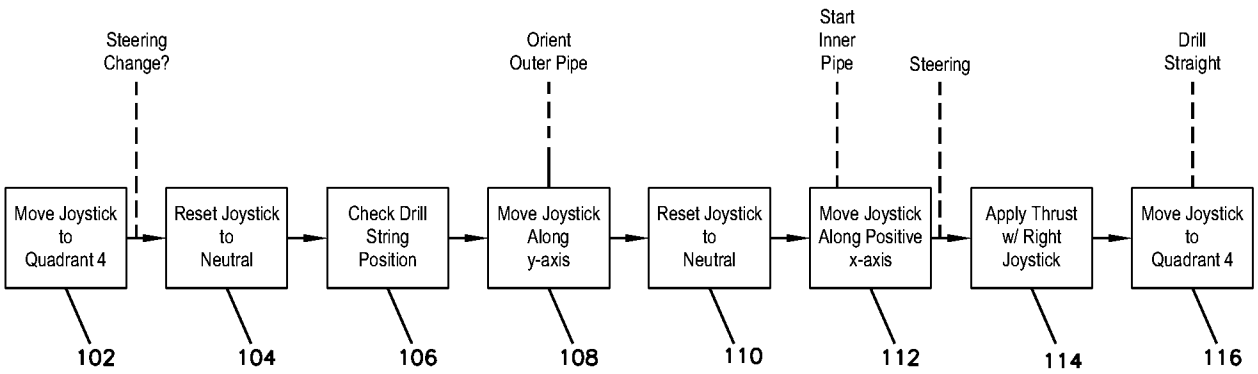
FIG. 9 is a flow chart showing the steps that are followed to make a drill string steering change of the system in FIG. 1 while drilling.

FIG. 9 shows a flow chart of steps that are followed to make a steering change while drilling. During the drilling process the operator will spend most of his time is quadrant 4 rotating both the inner 32 and outer rods 34 in the second rotational directions causing the drill to bore a straight hole. While drilling straight with the joystick 64, and in quadrant 4, the operator will monitor his position and determine when a steering change is desired (see Box 102). The first step to initiate a steering change will be to reset the joystick 64 to the neutral position 80 (see Box 104) which will effectively stop the rotation of both the inner 32 and outer rods 34. The operator will then check the position of the outer rod 34 (see Box 106) by checking the controls in the operator's station and checking with a locator operator positioned above the drill string 28 in the field. Once a desired steering direction is determined, the operator will move the joystick 64 along the y-axis 84 (see Box 108) to orient the outer rod 34 to a certain rotational position (i.e. a desired clock face position) to achieve a desired steering direction. Once the orientation is complete, the operator will again reset the joystick 64 (see Box 110) to the neutral position therefore stopping the rotation the outer rod 34. The operator will then move the joystick along the x-axis 82 between quadrant 1 and quadrant 4 (see Box 112) which will start the clockwise rotation of the inner rod 32 while the outer rod 34 does not rotate. Once rotation is started the operator will apply thrust to the drill string 28 (see Box 114) via the right joystick 66 which will effectively cause the drill string 28 to deflect and steer to a new boring path. When the operator has completed steering and desires to start boring a straight hole he will move the joystick 64 from the x-axis 82 down into quadrant 4 (see Box 116) which will start the clockwise rotation of the outer rod 34. This process will be repeated multiple times.

While the present disclosure depicts a steering system that uses a bent sub, bent housing, or like bent steering structure to provide steering functionality, it will be appreciated that other types of steering structures can also be used. For example, steering structures can include wedges or other deflection structures.

What is claimed is:

1. A dual drive drilling system comprising:

a plurality of drill rods that make up a drill string;

a steering element for controlling the path of the drill string;

a drill bit located near the end of the drill string;

a first rotational drive for controlling the rotation of a steering element;

a second rotational drive for controlling the rotation of a drill bit; and a joystick capable of moving along a first and second axis for controlling both the first and second rotational drives, wherein, during drilling, the movement of the joystick along the first axis controls rotation of the first rotational drive, and the movement of the joystick along the second axis controls rotation of the second rotational drive.

2. The system of claim 1, further comprising a speed control knob for limiting a maximum rotational speed of the second rotational drive.

3. The system of claim 1, wherein the joystick is self-centering, defining a neutral position along both the first and second axes.

4. The system of claim 1, wherein the drill string comprises an inner drill string of inner rods and an outer drill string of outer drill rods, the steering element for controlling the path of the drill string rotating with the outer drill string and being located at the end of the outer drill string, the drill bit rotating with the inner drill string and being located at the end of the inner drill string, the first rotational drive being coupled to the outer drill string for controlling the rotation of the outer drill string and the steering element, and the second rotational drive being coupled to the inner drill string for controlling the rotation of the inner drill string and the drill bit.

5. The system of claim 1, further comprising a stop function that stops rotation of the second rotational drive when the first rotational drive stops rotation.

6. The system of claim 5, further comprising a control function that, after the stop function is activated, prevents the rotation of the first rotational drive until the joystick is positioned to a neutral position along both the first and second axes.

7. The system of claim 1, further comprising a forward facing operator station, the operator station having a seat that has a front and rear portion that further defines an operator station axis that runs from the rear of the seat to the front of the seat, wherein the movement of the joystick along the first axis is generally along the operator station axis, and movement in the direction generally towards the rear of the seat along the first axis controls the clockwise rotation of first rotational drive, and movement in the direction generally towards the front of the operator seat along the first axis controls the counterclockwise rotation of the first rotational drive.

8. The system of claim 1, further comprising a forward facing operator station, the operator station having a seat that has a front and rear portion that further defines an operator station axis that runs from the rear of the seat to the front of the seat, wherein the movement of the joystick along the second axis is generally along the operator station axis, and movement of the joystick along the second axis in a direction towards the operator seat controls the clockwise rotation of second rotational drive, and movement in a direction away from the operator seat along the second axis controls the counterclockwise rotation of the second rotational drive.

9. The system of claim 1, wherein movement of the joystick along both the first and second axes causes the rotation of both the first rotational drive and the second rotational drive proportional to the proximity of the joystick to the first and second axes.

10. The system of claim 1, wherein the first axis is defined as the vertical y-axis and the second axis is defined as the horizontal x-axis.

11. The system of claim 1, further comprising a throttle capable of controlling the amount of thrust applied to the steering element and to the drill bit during drilling;

a speed control knob for limiting a maximum rotational speed of the second rotational drive during drilling;

a steering element speed switch that controls maximum speed of the steering element during drilling;

a switch capable of initiating an auto-drill operation at the rotational speeds set by the location of the joystick during drilling; and a stop function that stops rotation of the second rotational drive that is initiated when the first rotational drive stops rotation.

12. The system of claim 1, further comprising a throttle capable of controlling the amount of thrust applied to the steering element and to the drill bit during drilling.

13. The system of claim 1, further comprising a speed control knob for limiting a maximum rotational speed of the second rotational drive during drilling.

14. The system of claim 1, further comprising a steering element speed switch that controls maximum speed of the steering element during drilling.

15. The system of claim 1, further comprising a switch capable of initiating an auto-drill operation at the rotational speeds set by the location of the joystick during drilling.

16. The system of claim 1, further comprising a stop function that stops rotation of the second rotational drive that is initiated when the first rotational drive stops rotation.

17. A method of controlling a dual drive drilling system having a plurality of drill rods that make up a drill string, a steering element for controlling the path of the drill string, a drill bit located near the end of the drill string, a first rotational drive for controlling the rotation of a steering element, a second rotational drive for controlling the rotation of a drill bit and a first joystick, the method comprising:

moving the first joystick along a first axis to control rotation of the first rotational drive during drilling; and moving the first joystick along a second axis to control rotation of the second rotational drive during drilling.

18. The method of claim 17, further comprising a second joystick for controlling the thrust of the dual drive drilling system.

19. The method of claim 17, wherein the first joystick is self-centering, the center position defined as a neutral position.

* * * * *